US010034591B2

(12) United States Patent
Park et al.

(10) Patent No.: US 10,034,591 B2
(45) Date of Patent: Jul. 31, 2018

(54) ROBOT CLEANER

(71) Applicant: SAMSUNG ELECTRONICS CO., LTD., Suwon-si, Gyeonggi-do (KR)

(72) Inventors: Sung Jin Park, Suwon-si (KR); Jun Young Lee, Seoul (KR); Dong Woo Ha, Hwaseong-si (KR); Heum Yong Park, Suwon-si (KR); Dong Hyun Lee, Suwon-si (KR); Dong Hun Lee, Ansan-si (KR); Jae Youl Jeong, Suwon-si (KR); Min Jae Kim, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 363 days.

(21) Appl. No.: 14/580,712

(22) Filed: Dec. 23, 2014

(65) Prior Publication Data

US 2015/0182090 A1 Jul. 2, 2015

(30) Foreign Application Priority Data

Dec. 30, 2013 (KR) ..... 10-2013-0167187

(51) Int. Cl.
*A47L 11/40* (2006.01)
*A47L 11/283* (2006.01)

(52) U.S. Cl.
CPC ..... *A47L 11/4069* (2013.01); *A47L 11/283* (2013.01); *A47L 11/4038* (2013.01);
(Continued)

(58) Field of Classification Search
CPC ..... A47L 11/4069; A47L 11/283; A47L 11/4038; A47L 11/4055; A47L 11/4058;
(Continued)

(56) References Cited

U.S. PATENT DOCUMENTS 9,560,947 B2 * 2/2017 Park ..... A47L 11/4066

FOREIGN PATENT DOCUMENTS

CN 1047024 A 11/1990
CN 1116818 A 2/1996
(Continued)

OTHER PUBLICATIONS

Extended European Search Report dated May 28, 2015 in corresponding European Patent Application No. 14200454.8.
(Continued)

*Primary Examiner* — Shay Karls
(74) *Attorney, Agent, or Firm* — Staas & Halsey LLP

(57) ABSTRACT

Disclosed is a robot cleaner capable of reducing the material cost thereof by use of fewer motors, and performing wet cleaning while travelling in all directions and rubbing the floor surface, the robot cleaner includes a plurality of motors generating driving forces, a plurality of pad assemblies configured to rotate by receiving a driving force from one of the plurality of motors, and provided in a tilted manner so that a bottom surface of each of the plurality of pad assemblies has an uneven frictional force with respect to a floor surface, and a tilt gear unit configured to simultaneously vary tilting directions of the plurality of pad assemblies by receiving a driving force from another one of the plurality of motors, wherein the robot clean can travel in all directions depending on a tilting direction and a rotational direction of each of the plurality of pad assemblies.

26 Claims, 11 Drawing Sheets

(52) U.S. Cl.
CPC ..... *A47L 11/4055* (2013.01); *A47L 11/4058* (2013.01); *A47L 11/4061* (2013.01); *A47L 11/4063* (2013.01); *A47L 2201/04* (2013.01)

(58) Field of Classification Search
CPC ..... A47L 11/4061; A47L 11/4063; A47L 2201/04
See application file for complete search history.

(56) References Cited

FOREIGN PATENT DOCUMENTS

| | | | |
|---|---|---|---|
| CN | 200951060 | Y | 9/2007 |
| CN | 201175868 | Y | 1/2009 |
| CN | 201948949 | U | 8/2011 |
| CN | 202015139 | U | 10/2011 |
| DE | 295 02 611 | | 7/1995 |
| DE | 103 14 379 | A1 | 10/2004 |
| JP | 9-234177 | | 9/1997 |
| JP | 9-299298 | | 11/1997 |
| KR | 10-2005-0012047 | | 1/2005 |
| KR | 10-2008-0091042 | | 10/2008 |
| KR | 10-2012-0003157 | | 1/2012 |
| KR | 10-2012-0009927 | | 2/2012 |
| WO | WO 95/14423 | | 6/1995 |
| WO | 2012/086604 | A1 | 6/2012 |

OTHER PUBLICATIONS

International Search Report dated Apr. 1, 2015 in corresponding International Patent Application No. PCT/KR2014/012823.

Shin et al., "Motion Analysis of Omni-directional Self-propulsive Polishing Robot", *Journal of Korea Society for Precision Engineering,* Jan. 1999, pp. 151-159, vol. 16, No. 5.

European Office Action dated May 13, 2016 in corresponding European Patent Application No. 14 200 454.8.

Australian Office Action dated Mar. 24, 2017, in corresponding Australian Patent Application No. 2014374621.

Australian Notice of Acceptance for Patent Application dated Sep. 8, 2017, in corresponding Australian Patent Application No. 2014374621.

Chinese Office Action dated May 4, 2018, in corresponding Chinese Patent Application No. 201480071896.0.

* cited by examiner

ROBOT CLEANER

CROSS-REFERENCE TO RELATED APPLICATIONS

This application claims the benefit of the Korean Patent Application No. 10-2013-0167187, filed on Dec. 30, 2013, in the Korean Intellectual Property Office, the disclosure of which is incorporated herein by reference.

BACKGROUND

1. Field

Embodiments of the present disclosure relate to a robot cleaner capable of travelling in all directions.

2. Description of the Related Art

A robot cleaner is a device configured to perform a cleaning task by suctioning foreign substance such as dust from a floor surface while independently travelling on a cleaning area without a manipulation of a user. The robot cleaner determines the distance from an obstacle installed within a cleaning area, such as furniture, office equipment and a wall, through a distance sensor, and selectively drives a left wheel motor and a right wheel motor thereof, thereby cleaning the cleaning area while independently changing the direction thereof.

In recent years, there has been introduced a robot cleaner capable of wiping off dust from a floor surface in addition to a robot cleaner capable of suctioning foreign substance, such as dust from, a floor surface. The conventional robot cleaner is provided with a pad at a lower surface thereof, and is configured to wipe off dust on a floor surface in ways that move along a floor surface while making contact with the floor surface.

At this time, the robot cleaner is moved by a transportation member that is separately provided.

SUMMARY

Therefore, it is an aspect of the present disclosure to provide a robot cleaner capable of driving in all directions by use of an uneven frictional force between a pad and a floor surface. In addition, the material cost of the robot cleaner may be reduced by use of fewer motors.

Additional aspects of the disclosure will be set forth in part in the description which follows and, in part, will be obvious from the description, or may be learned by practice of the disclosure.

In accordance with one aspect of the present disclosure, a robot cleaner includes a plurality of motors, a plurality of pad assemblies and a tilt gear unit. The plurality of motors may generate driving forces. The plurality of pad assemblies may be configured to rotate by receiving a driving force from one of the plurality of motors, and provided in a tilted manner so that a bottom surface of each of the plurality of pad assemblies has an uneven frictional force with respect to a floor surface. The tilt gear unit may be configured to simultaneously vary tilting directions of the plurality of pad assemblies by receiving a driving force from another one of the plurality of motors. The robot cleaner may travel in various directions depending on a tiling direction and a rotational direction of each of the plurality of pad assemblies.

The plurality of motors may include a first motor connected to the tilt gear unit and a plurality of second motors mounted at each of the plurality of pad assemblies.

The pad assembly may include a rotating panel, a tile spacer and a pad. The rotating panel may be configured to rotate by the second motor. The tilt spacer may be provided at a lower portion of the rotating panel and provided with a bottom surface thereof in an inclined manner. The pad may be provided at a lower portion of the tilt spacer.

An elastic unit may be provided in between the tilt spacer and the pad such that the elastic unit allows a bottom surface of the pad to entirely make contact with the floor surface.

The tilt spacer is connected to the tile gear unit so as to be rotated.

The pad assembly may further include a mounting unit, and the rotating panel is coupled to the mounting unit by the joint shaft.

The joint shaft may be provided with a locking bar at one end portion thereof, and the rotating panel may be provided with an interference unit configured to be interfered by the locking bar.

The tilt spacer may be provided with a hole formed therethrough, while the joint shaft passes through the hole.

A first gear may be provided at the other end portion of the joint shaft, and the first gear is connected to the second motor, so that the joint shaft and the rotating panel are simultaneously rotated by a driving force of the second motor.

A second gear may be provided at the mounting unit, and the second gear may be tooth-coupled to the tilt gear unit.

The driving force of the first motor is delivered to the second gear through the tilt gear unit, thereby rotating the tilt spacer.

The pad assembly includes a first pad assembly, a second pad assembly positioned at the right side of the first pad assembly, a third pad assembly positioned at the front of the second pad assembly and a fourth pad assembly positioned at the left side of the third pad assembly.

Tilting directions of the first pad assembly and the second pad assembly are bilaterally symmetrical to each other, and tilting directions of the third pad assembly and the fourth pad assembly to be bilaterally symmetrical to each other.

Rotational directions of the first pad assembly and the second pad assembly are opposite to each other, and rotational directions of the third pad assembly and the fourth pad assembly are opposite to each other.

The driving force of the first motor is simultaneously transmitted to a tile spacer included in the first pad assembly, a tile spacer included in the second pad assembly, a tile spacer included in the third pad assembly, and a tile spacer included in the fourth pad assembly through the tilt gear unit.

In accordance with another aspect of the present disclosure, a robot cleaner includes a first motor provided at a base, a plurality of pad assemblies provided at the base in a tilting manner, a tilt gear unit, and a plurality of second motors. The plurality of pad assemblies may each have a mounting unit mounted at the base, a tilt spacer provided at a lower portion of the mounting unit and provided with a bottom surface thereof formed in a tilted manner, a rotating panel rotatably provided at the bottom surface of the tilt spacer, and a pad configured to clean a floor surface. The tilt gear unit may be configured to simultaneously deliver a rotating force of the first motor to the plurality of tilt spacers provided at the plurality of pad assemblies. The plurality of second motors may be each mounted at each of the plurality of pad assemblies to rotate the pad assembly clockwise or counter-clockwise. A traveling direction of the robot cleaner may be varied by an uneven frictional force between a bottom surface of the pad and the floor surface.

As the rotating force of the first motor is delivered to the tilt spacer through the tilt gear unit, the tilt spacer may be rotated clockwise or counter-clockwise, so that a tilting direction of the pad assembly is varied.

The tilt spacers provided at the plurality of pad assemblies, respectively, may be simultaneously rotated in the same direction by the tilt gear unit.

The pad assembly may further include a joint shaft provided with a hooking unit formed configured to interfere with the rotating panel, and the joint shaft may be rotatably connected to the second motor.

An elastic unit may be provided in between the rotating panel and the pad such that the elastic unit allows the bottom surface of the pad to entirely make contact with the floor surface.

In accordance with one embodiment of the present disclosure, a robot cleaner can perform a wet cleaning while rubbing off a floor surface in a course of travelling in all directions, and is provided with less number of motors, thereby reducing material costs.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
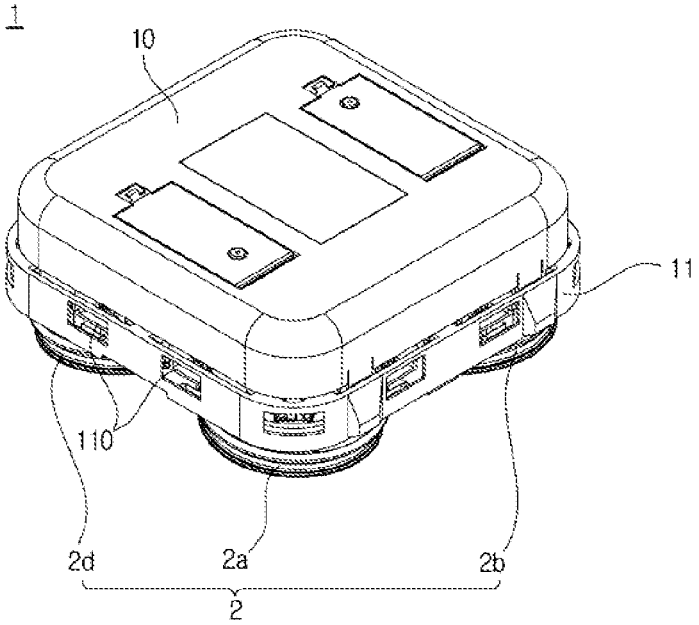
FIG. 1 is a perspective view illustrating a robot cleaner in accordance with one embodiment of the present disclosure.

Reference will now be made in detail to the embodiments of the present disclosure, examples of which are illustrated in the accompanying drawings, wherein like reference numerals refer to like elements throughout.

Figure 2:
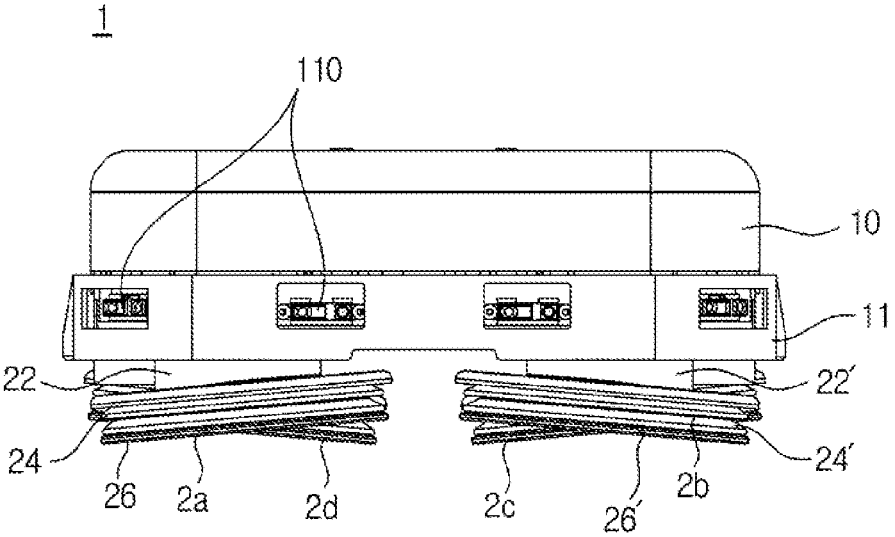
FIG. 2 is a side view illustrating the robot cleaner in accordance with one embodiment of the present disclosure.
Figure 3:
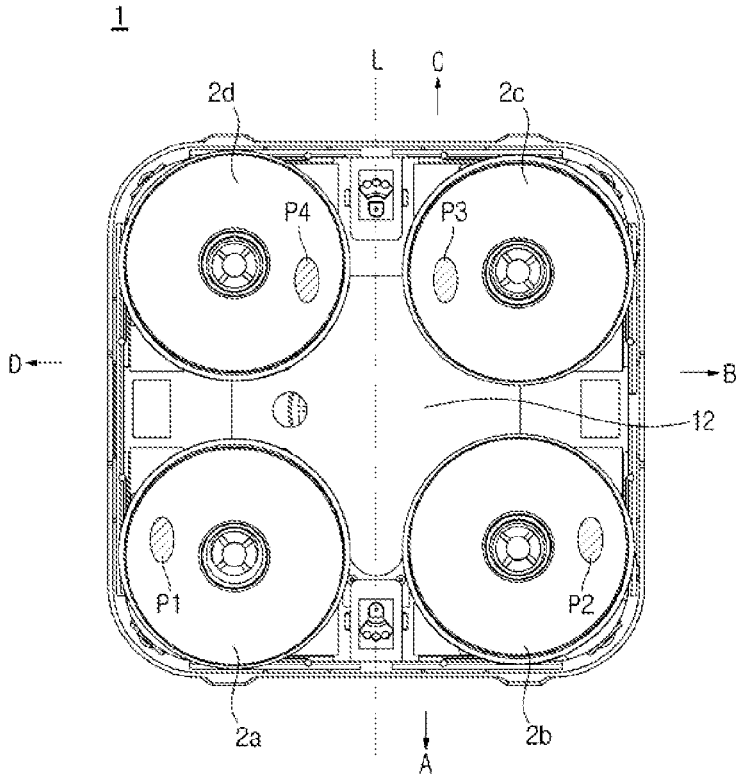
FIG. 3 is a drawing illustrating a bottom surface of the robot cleaner in accordance with one embodiment of the present disclosure.

FIG. 1 is a perspective view of an robot cleaner in accordance with one embodiment of the present disclosure, FIG. 2 is a side view of the robot cleaner in accordance with one embodiment of the present disclosure, and FIG. 3 is a drawing illustrating a bottom surface of the robot cleaner in accordance with one embodiment of the present disclosure.

Referring to FIGS. 1 to 3, a robot cleaner 1 in accordance with one embodiment of the present disclosure includes a pad assembly 2, a cover 10, and a bumper 11. The pad assembly 2 may include a plurality of pad assemblies 2. The robot cleaner 1 is capable of travelling in various directions by use of an uneven frictional force between a bottom surface of the pad assembly 2 and the floor surface. The cover 10 is configured to cover an upper portion of the robot cleaner 1. The bumper 11 is provided at sides of the robot cleaner 1, and is configured to absorb an outside impact applied to the robot cleaner 1. A sensor 110 may be provided at a side of the robot cleaner 1. The sensor 110 is capable of detecting an obstacle positioned at the surroundings of the robot cleaner 1.

The robot cleaner 1 may include the plurality of pad assemblies 2. As one example, the pad assembly 2 may include a first pad assembly 2*a*, a second pad assembly 2*b*, a third pad assembly 2*c*, and a fourth pad assembly 2*d*. The number of the pad assemblies 2 may differ from the above example. Hereinafter, an embodiment, in which the pad assembly 2 having the first pad assembly 2*a*, the second pad assembly 2*b*, the third pad assembly 2*c*, and the fourth pad assembly 2*d*, will be described. The first pad assembly 2*a*, the second pad assembly 2*b*, the third pad assembly 2*c*, and the fourth pad assembly 2*d* may be disposed on the robot cleaner 1 in the order of a clockwise direction.

The pad assemblies 2 may be provided in an inclined manner at a predetermined angle with respect to the floor surface. The pad assemblies 2 may be provided in an inclined manner at a predetermined angle with respect to the floor surface by tilt spacers 22 and 22'. One surface of each of the tilt spacers 22 and 22' may be provided with a shape having a predetermined inclination angle.

For example, when one surface of each of the tilt spacers 22 and 22' is placed on the floor surface, the one surface of each of the tilt spacers 22 and 22' may be provided in a way to form a predetermined angle with respect to the floor surface. An angle formed between the floor surface and the one surface of each of the tilt spacers 22 and 22' may be referred to as an inclination angle. As one example, the inclination angle of each of the tilt spacers 22 and 22' may be about 7.5°.

By the tilt spacers 22 and 22', the pad assembly 2 may be able to rotate while having a z-axis as a center of rotation in a state of being inclined at a predetermined angle with respect to the floor surface. That is, the pad assemblies 2 may be able to rotate while having the z-axis as a center of rotation in a tilted state by the tilt spacers 22 and 22'. Pads 26 and 26' provided at bottom surfaces of the pad assemblies 2, by elastic members 24 and 24' interposed between the tilt spacers 22 and 22' and the pads 26 and 26', may be able to rotate while having the z-axis as a center of rotation, as the bottom surfaces of the pads 26 and 26' as a whole are in a state of making contact with the floor surface. However, as the pad assembly 2 is rotated in an inclined manner at a predetermined angle with respect to the floor surface, the frictional forces between the bottom surfaces of the pads 26 and 26' and the floor surface may be generated in an uneven manner. The frictional force between a certain portion of the bottom surfaces of the pads 26 and 26' and the floor surface may be greater than when compared to the frictional force from other portions of the bottom surfaces of the pads 26 and 26' and the floor surface due to the inclined one surfaces of the tilt spacers 22 and 22'. The robot cleaner 2 may be able to travel by the uneven frictional force between the bottom surfaces of the pads 26 and 26' and the floor surface.

As illustrated on FIG. 3, as one example, when the bottom surface of the robot cleaner 1 is viewed, with respect to the pad assembly 2, the first pad assembly 2*a*, the second pad assembly 2*b*, the third pad assembly 2*c*, and the fourth pad assembly 2*d* may be provided in the order of a clockwise direction. The third pad assembly 2*c* may be positioned at a front of the first pad assembly 2*a* while the fourth pad assembly 2*d* may be positioned at a front of the second pad assembly 2*b*.

A portion of the bottom surface of the first pad assembly 2*a* having the greater frictional force with respect to the floor surface may be positioned in symmetrical to a portion of the bottom surface of the second pad assembly 2*b* having the greater frictional force with respect to the floor surface. A portion of the bottom surface of the fourth pad assembly 2*d* having the greater frictional force with respect to the floor surface may be positioned in symmetrical to a portion of the bottom surface of the third pad assembly 2*c* having the greater frictional force with respect to the floor surface.

With an assumption of a linear line 'L', which is provided in a way to position the first pad assembly 2*a* and the fourth pad assembly 2*d* at a left side, and also is provided in a way to position the second pad assembly 2*b* and the third pad assembly 2*c* at a right side, a potion 'P1' of the first pad assembly 2*a* having the greater frictional force with respect to the floor surface may be positioned in symmetric to a potion 'P2' of the second pad assembly 2*b* having the greater frictional force with the floor surface while having the linear line 'L' as a center of the symmetry. The a potion 'P4' of the fourth pad assembly 2*d* having the greater frictional force with respect to the floor surface may be positioned in symmetric to a potion 'P3' of the third pad assembly 2*c* having the greater frictional force with the floor surface while having the linear line 'L' as a center of the symmetry.

On the assumption when the bottom surface of the robot clearer 1 is provided in a rectangular shape, when direction A is defined as direction in which the robot cleaner 1 advances while having the first and second pad assemblies 2*a* and 2*b* positioned at the front of the robot cleaner, direction B, C and D are defined as directions sequentially designated in the order of clockwise direction. That is, direction B is defined as direction in which the robot cleaner 1 advances while having the second and third pad assemblies 2*b* and 2*c* positioned at the front of the robot cleaner 1, direction C is defined as direction in which the robot cleaner 1 advances while having the third and fourth pad assemblies 2*c* and 2*d* positioned at the front of the robot cleaner 1, and direction D is defined as direction in which the robot cleaner 1 advances while having the fourth and first pad assemblies 2*d* and 2*a* positioned at the front of the robot cleaner 1.

As one example, in an initial state prior to the robot cleaner 1 being driven, the portions of the bottom surfaces of the first pad assembly 2*a* and the second pad assembly 2*b* which have the greater frictional force may be provided to be positioned at an outer side of the robot cleaner 1. The portions of the bottom surfaces of the third pad assembly 2*c* and the fourth pad assembly 2*d* which have the greater frictional force may be provided to be positioned at an inner side of the robot cleaner 1.

That is, the first pad assembly 2*a* may be provided in a way that frictional force with respect to the floor surface is the greater at portion 'P1' of the bottom surface of the pad 26 positioned at the direction 'D'. The second pad assembly 2*b* may be provided in a way that frictional force with respect to the floor surface is the greater at portion 'P2' of the bottom surface of the pad 26' positioned at the direction 'B'. The third pad assembly 2*c* may be provided in a way that frictional force with respect to the floor surface is the greater at portion 'P3' of the bottom surface of the pad positioned at the direction 'D'. The fourth pad assembly 2*d* may be provided in a way that frictional force with respect to the floor surface is the greater at portion 'P4' of the bottom surface of the pad positioned at the direction 'B'.

Hereinafter, a case in which the portion having greater frictional force in between the bottom surface of the pad assembly and the floor surface is positioned at each of P1, P2, P3, and P4 as the above will be described.

The portion having greater frictional force at the bottom surface of the pad assembly 2 may be different from the above embodiment. However, with respect to pad assemblies which are positioned adjacent to each other at the left and right sides of the linear line 'L', portions of bottom surface of the pad assemblies having greater frictional force with respect to the floor surface may be provided to be symmetrical to each other while having the linear line 'L' as a center of the symmetry.

Figure 4:
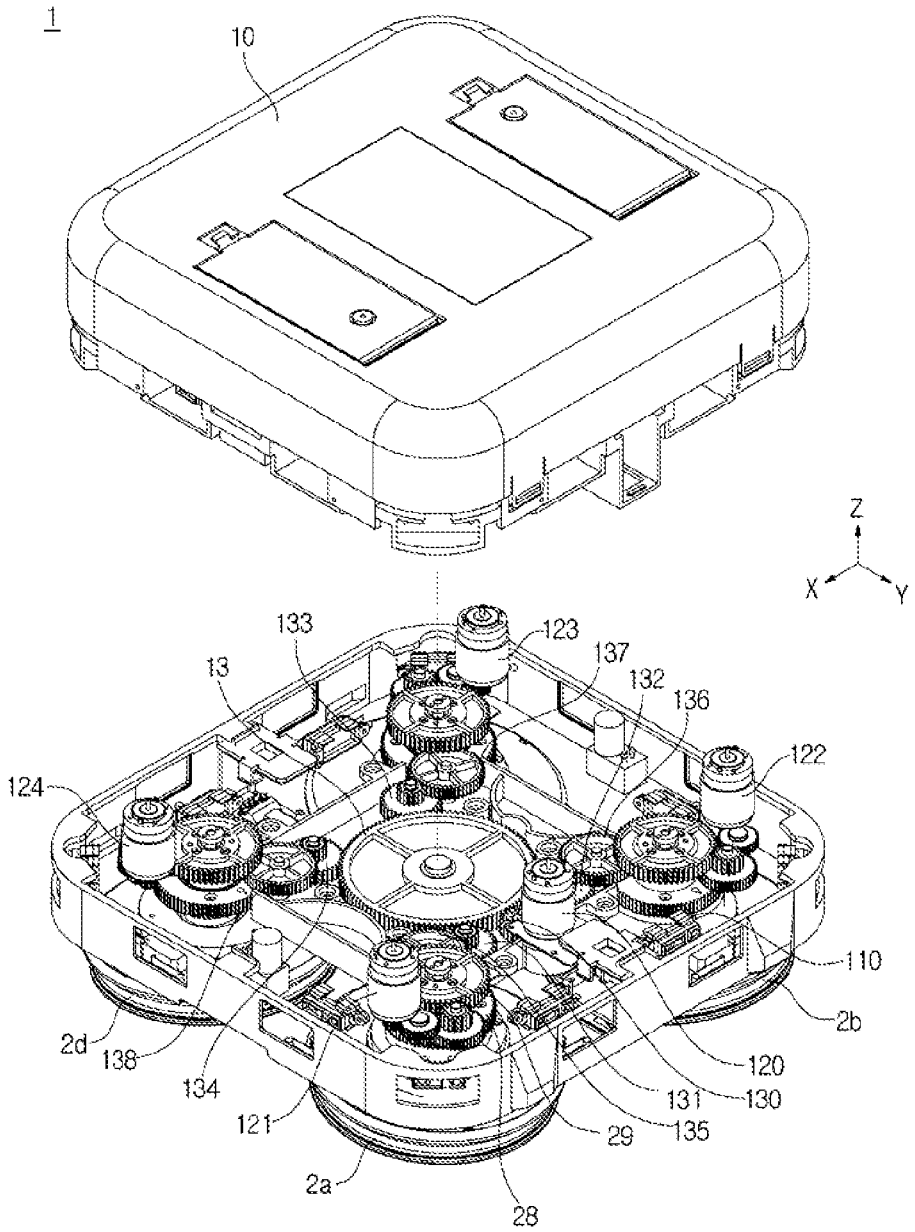
FIG. 4 is a drawing illustrating the robot cleaner having a cover thereof removed in accordance with one embodiment of the present disclosure.
Figure 5:
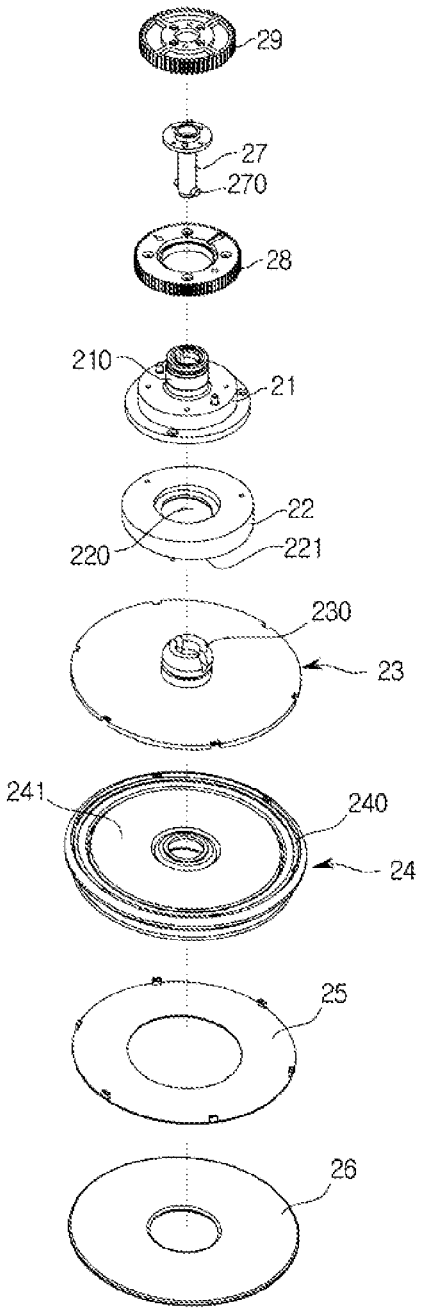
FIG. 5 is a drawing illustrating a portion of the robot cleaner in accordance with one embodiment of the present disclosure.
Figure 6:
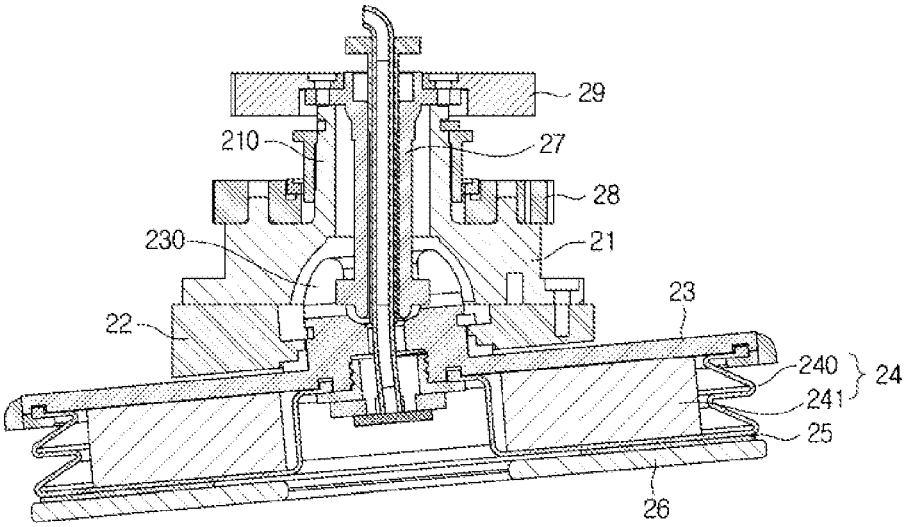
FIG. 6 is a cross-sectional view illustrating a portion of the robot cleaner in accordance with one embodiment of the present disclosure.

FIG. 4 is a drawing illustrating an image of the robot cleaner provided with a cover thereof removed in accordance with one embodiment of the present disclosure, FIG. 5 is a drawing illustrating a portion of the robot cleaner in accordance with one embodiment of the present disclosure, and FIG. 6 is a cross-sectional view of a portion of the robot cleaner in accordance with one embodiment of the present disclosure.

Referring to FIGS. 4 to 6, the robot cleaner 1 in accordance with one embodiment of the present disclosure may include a base 12, a first motor 120 mounted at the base 12, and second motors 121, 122, 123, and 124 mounted at the pad assemblies 2. The driving force of the first motor 120 may be delivered to the pad assemblies 2 through a tilting gear unit. The direction of an inclination of the pad assemblies 2 may be varied as the pad assemblies 2 are rotated by the first motor 120. The second motors 121, 122, 123, and 124 may be able to rotate the pad assemblies 2 in a clockwise direction or a counter-clockwise direction while having the z-axis as a center of rotation.

The structures of the first pad assembly 2*a*, the second pad assembly 2*b*, the third pad assembly 2*c*, and the fourth pad assembly 2*d* are similar, and thus hereinafter, the structure of the first pad assembly 2*a* will be described.

The first pad assembly 2*a* may include a mounting unit 21, a tile spacer 22, a rotating panel 23, an elastic unit 24, a pad mounting unit 25, and the pad 26. The mounting unit 21 may be mounted at the base 12. At the mounting unit 21, the second motor 121 may be mounted. At the mounting unit 21, an extension unit 210 provided with a hollow hole formed thereto may be provided.

Into the hollow hole formed at the extension unit 210, a joint shaft 27 connected to the rotating panel 23 may be inserted. At an inside the joint shaft 27, a hole may be formed in a longitudinal direction. Through the hole formed at the joint shaft 27, water that is introduced from a water tank may be supplied toward the pad 26.

At one end potion of the joint shaft 27, a second gear 29 capable of receiving a driving force of the second motor 121 may be mounted. The second gear 29 may be tooth-coupled to connecting gears 280 and 281 that are connected to the second motor 121. The connecting gears 280 and 281 include a first connecting gear 280 and a second connecting gear 281. The first connecting gear 280 is connected to the second motor 121, and the second connecting gear 281 may be tooth-coupled to the first connecting gear 280. The second connecting gear 281 may be tooth-coupled to the second gear 29. As the second motor 121 is driven, the connecting gears 280 and 281 are rotated, and as the connecting gears 280 and 281 are rotated, the second gear 29 may be rotated. As the second gear 29 is rotated, the rotating panel 23 connected to the second gear 29 may be rotated while having the z-axis as a center of rotation.

At the other end portion of the joint shaft 27, a locking bar 270 configured to perpendicular to the longitudinal direction of the joint shaft 27 may be formed. The locking bar 270 may be mounted at an interference unit 230 formed at the rotating panel 23. At the interference unit 230, an accommodating unit referred to as a space in which the locking bar 270 may be accommodated is formed, and the locking bar 270 may be accommodated in the accommodating unit. As the locking bar 270 is mounted at the interference unit 230, the joint shaft 27 is rotated by the second motor 121 while having the z-axis as a center of rotation, and thus the rotating panel 23 may be able to rotate while having the z-axis as a center of rotation.

In the case as the above, the locking bar 270 may be provided with a certain gap within the interference unit 230, and thus even in a case when the tilt angle of the rotating panel 23 is changed, regardless of the tilt angle of the rotating panel 23, the locking bar 270 is formed in the structure capable of delivering a rotational force to the rotating panel 23. Other than the structure as the above, different forms of structures, which are capable of delivering a rotational force in a tilted state of the rotating panel 23, such as a universal joint, may be employed.

At a lower portion of the mounting unit 21, the tilt spacer 22 may be positioned. At the tilt spacer 22, a hole 220 may be formed. The joint shaft 27 may penetrate the hole 220. Even in a case when the joint shaft 27 is rotated while having the z-axis as a center of rotation by receiving a driving force from the second motor 121, the tilt spacer 22 may be provided in a way not to be rotated.

A bottom surface 221 of the tilt spacer 22 may be formed in a way to form a predetermined angle with respect to the floor surface. The rotating panel 23 positioned at the lower portion of the tilt spacer 22 may be disposed in a way to form a predetermined angle with respect to the floor surface along the inclination of the bottom surface of the tilt spacer 22.

At an upper portion of the rotating panel 23, the interference unit 230 at which the joint shaft 27 may be mounted may be provided. The interference unit 230 may be provided at an upper portion surface of the rotating panel 23. At the interference unit 230, an accommodating unit protruded from the upper portion surface of the rotating panel 23 and in which the locking bar 270 may be accommodated may be formed. The locking bar 270 may be mounted at and accommodated in the accommodating unit. As the joint shaft 27 is rotated, the interference unit 230 is interfered by the locking bar 270, and the rotating panel 23 may be able to be rotated together with the joint shaft 27.

At a lower portion of the rotating panel 23, the elastic unit 24 may be provided. By the elastic unit 24, the entire surface of the pad 26 may be able to make contact with the floor surface. The elastic unit 24 may include an elastic member accommodating unit 240 and an elastic member 241. The elastic member accommodating unit 240 may be provided in the shape of a flexible tube having a plurality of corrugations. The elastic member accommodating unit 240 may be provided with rubber material through which water may not be able to smear or penetrate. As described above, the elastic member 241 may be prevented from being wet by the water supplied to the pad 26. The elastic member 241 may be accommodated in the elastic member accommodating unit 240. The elastic member 241 may be provided with the material such as sponge. Even in a case when the rotating panel 23 is inclined to form a predetermined angle with respect to the floor surface, the pad 26 positioned at the lower portion of the elastic unit 24 may make contact entirely with the floor surface.

At the bottom surface of the elastic unit 24, the pad mounting unit 25 may be implemented. At the bottom surface of the pad mounting unit 25, the pad 26 may be mounted. The pad 26 may be detachably mounted at the pad mounting unit 25. As one example, the pad 26 may be mounted at the bottom surface of the pad mounting unit 25 by a Velcro method.

Figure 7:
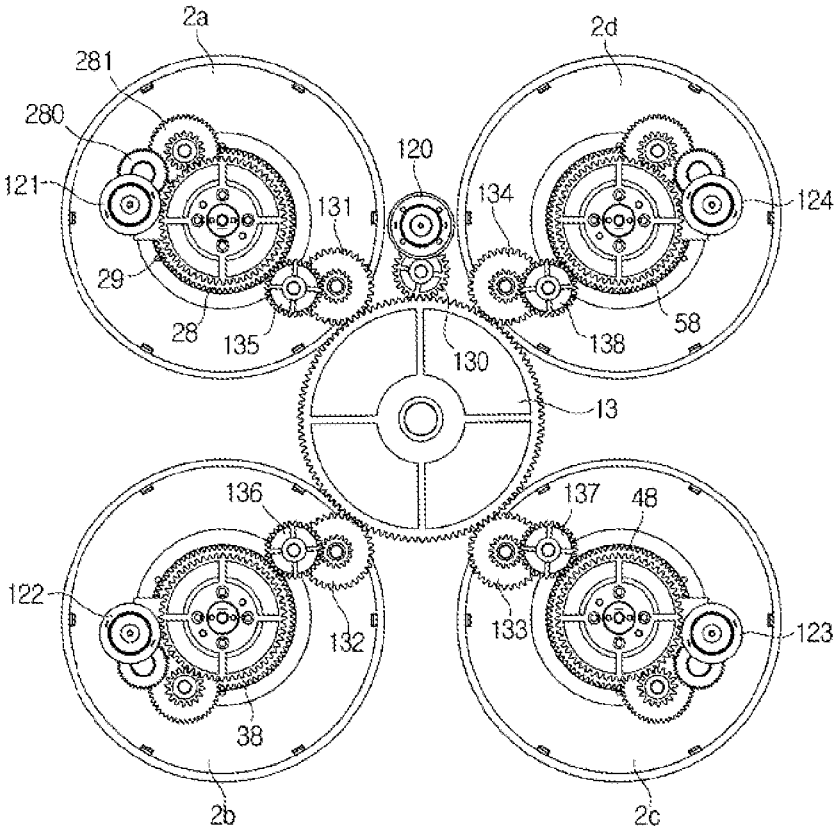
FIG. 7 is a drawing illustrating the robot cleaner provided with a tilt gear unit connected to a pad assembly in accordance with one embodiment of the present disclosure.

FIG. 7 is a drawing illustrating an image of the robot cleaner provided with the tilt gear unit and the pad assembly connected with respect to each other in accordance with one embodiment of the present disclosure.

Referring to FIGS. 4 to 7, the tilt spacers 22 and 22' of the robot cleaner 1 in accordance with one embodiment of the present disclosure may be rotated by the first motor 120. As the tilt spacers 22 and 22' are rotated, the position of the portion having greater frictional force in between the bottom surface of the pad assembly 2 and the floor surface may be varied, and thus the travelling direction of the robot cleaner 1 may be changed. The driving force of the first motor 120 may be delivered through a tilt gear unit to the tilt spacers 22 and 22'.

The tilt gear unit includes a tilt gear 13, a driving gear 130, and a first connecting gear and a second connecting gear connected to the pad assembly 2. The tilt gear 13 may be rotated by being delivered with a driving force from the first motor 120.

The driving gear 130 is connected to the first motor 120, and the driving gear 130 may be tooth-coupled to the tilt gear 13. As the driving gear 130 is rotated by the first motor 120, the tilt gear 13 tooth-coupled to the driving gear 130 may be rotated. As the driving gear 130 is rotated in a counter-clockwise direction by the first motor 120, the tilt gear 13 may be rotated in a clockwise direction. As the driving gear 130 is rotated in a clockwise direction by the first motor 120, the tilt gear 13 may be rotated in a counter-clockwise direction.

The tilt gear 13 may be connected to a first gear 28 mounted at the tilt spacer 22 through a connecting gear. The tilt gear 13 may be connected to the first gear 28 mounted at the tilt spacer 22 through the first connecting gear 131 and the second connecting gear 135. The tilt gear 13 is tooth-coupled to the first connecting gear 131, and the first connecting gear 131 may be tooth-coupled to the second connecting gear 135. The first gear 28 may be tooth-coupled to the second connecting gear 135. The tilt spacer 22 may be rotated together with the first gear 28. As the tilt gear 13 is rotated, the rotational force is delivered through the first connecting gear 131 and the second connecting gear 135, and the first gear 28 is rotated. The tilt spacer 22 may be rotated together with the first gear 28.

As the tilt gear 13 is rotated in a clockwise direction, the first connecting gear 131 is rotated in a counter-clockwise direction. As the first connecting gear 131 is rotated in a counter-clockwise direction, the second connecting gear 135 is rotated in a clockwise direction. As the second connecting gear 135 is rotated in a clockwise direction, the first gear 28 is rotated in a counter-clockwise direction. The tilt spacer 22 may be rotated in a counter-clockwise direction together with the first gear 28. The tilt gear 13 and the tilt spacer 22 may be rotated in opposite directions with respect to each other. As the tilt gear 13 is rotated in a counter-clockwise direction, the tilt spacer 22 may be rotated in a counter-clockwise direction. The tilt spacer 22 may be rotated in an identical direction with respect to the driving gear 130.

The second pad assembly 2*b*, the third pad assembly 2*c*, and the fourth pad assembly 2*d* may be connected to the tilt gear 13 in a similar manner as in the first pad assembly 2*a*. A first gear 38 is mounted at the tilt spacer 22' of the second pad assembly 2*b*, and the first gear 38 may be connected to the tilt gear 13 through a first connecting gear 132 and a second connecting gear 136. A first gear 48 is mounted at the tilt spacer of the third pad assembly 2*c*, and the first gear 48 may be connected to the tilt gear 13 through a first connecting gear 133 and a second connecting gear 137. A first gear 58 is mounted at the tilt spacer of the fourth pad assembly 2*d*, and the first gear 58 may be connected to the tilt gear 13 through a first connecting gear 134 and a second connecting gear 138. The tilt spacers provided at the second pad assembly 2*b*, the third pad assembly 2*c*, and the fourth pad assembly 2*d* may be rotated in opposite directions with respect to rotational directions of the tilt gear 13.

As described above, the tilt spacer provided at the pad assembly 2 may be rotated in an identical direction with respect to the rotational direction of the driving gear 130. The tilt spacer is rotated in a different direction with respect to the tilt gear 13, and thus the direction of inclination may be varied. That is, as the tilt spacer is rotated, the position of the portion having greater frictional force in between the bottom surface of the pad assembly 2 and the floor surface may be varied. As the position of the portion having greater frictional force in between the bottom surface of the pad assembly 2 and the floor surface is changed, the travelling direction of the robot cleaner 1 may be changed.

The tilt spacer may be rotatably provided on the rotating panel 23 separately from the rotating panel 23 without being fixed to the rotating panel 23. Thus, even in a case when the tilt spacer is rotated by the first motor 120, the elastic member 24, the pad mounting unit 25 and the pad 26 mounted at the rotating panel 23, as well as the rotating panel 23 are not rotated together with the tilt spacer. The first motor 120 may be able to change the direction of inclination, which is formed by the bottom surface of the tilt spacer with respect to the floor surface, by rotating the tilt spacer. The second motors 121, 122, 123, and 124 may be able to rotate the rotating panel 23 of the pad assembly 2 in a clockwise direction or in a counter-clockwise direction.

In a case when the travelling direction of the robot cleaner 1 is needed to be changed, the first motor 120 is driven and the tilt spacer may be rotated by a predetermined angle. When the tile spacer is rotated by the predetermined angle, the position of the portion having greater frictional force in between the bottom surface of the pad assembly 2 and the floor surface may be changed within the bottom surface of the pad assembly 2. As the position of the portion having greater frictional force in between the bottom surface of the pad assembly 2 and the floor surface is changed, the travelling direction of the robot cleaner 1 may be changed.

Hereinafter, an embodiment in which the travelling direction of the robot cleaner 1 is changed will be described by referring to the drawings.

Figure 8A:
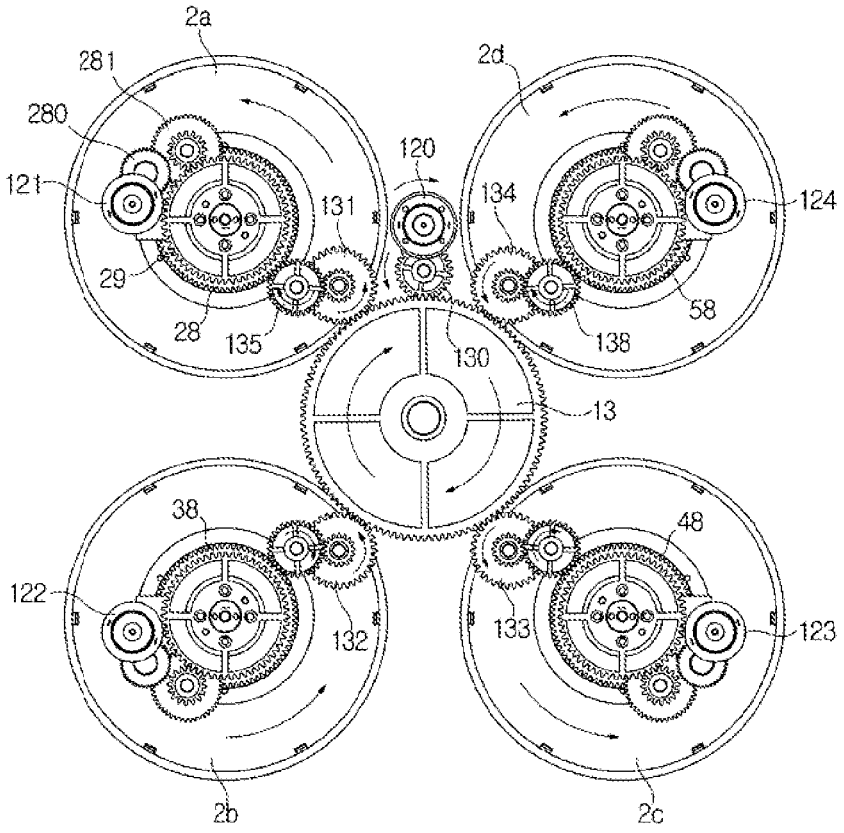
FIGS. 8A and 8B are drawings illustrating the robot cleaner driving in a diagonal direction in accordance with one embodiment of the present disclosure.
Figure 8B:
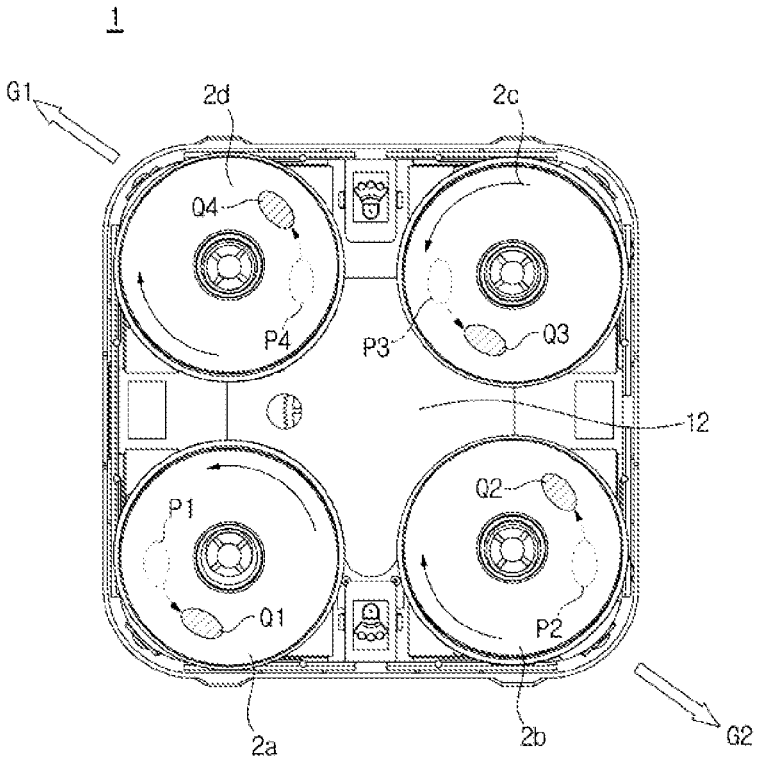

FIGS. 8A and 8B are drawings illustrating an image of the robot cleaner driving in a diagonal direction in accordance with one embodiment of the present disclosure.

By referring to FIG. 8A and FIG. 8B, the travelling direction of the robot cleaner 1 in accordance with one embodiment of the present disclosure may be changed during a course of driving. The tilt spacer is rotated by the first motor 120, and the position of the portion having greater frictional force in between the bottom surface of the pad assembly 2 and the floor surface is changed, and thus the travelling direction of the robot cleaner 1 may be changed. The following description will be made in relation to a case that the travelling direction of the robot cleaner 1 having been driven in a linear direction is changed in a diagonal direction.

During the course of a linear driving, the first pad assembly 2*a* may be rotated in a counter-clockwise direction by the second motor 121. At the first pad assembly 2*a*, the portion having greater frictional force in between the bottom surface of the first pad assembly 2*a* and the floor surface may be the position 'P1'. The second pad assembly 2*b* may be rotated by the second motor 122 in a clockwise direction. At the second pad assembly 2*b*, the portion having greater frictional force in between the bottom surface of the first pad assembly 2*b* and the floor surface may be the position 'P2'. The third pad assembly 2*c* may be rotated by the second motor 123 in a counter-clockwise direction. At the third pad assembly 2*c*, the portion having greater frictional force in between the bottom surface of the third pad assembly 2*c* and the floor surface may be the position 'P3'. The fourth pad assembly 2*d* may be rotated by the second motor 123 in a clockwise direction. At the fourth pad assembly 2*d*, the portion having greater frictional force in between the bottom surface of the fourth pad assembly 2*d* and the floor surface may be the position 'P4'.

As the driving gear 130 is rotated in a counter-clockwise direction by the first motor 120, the tilt gear 13 may be rotated in a clockwise direction. As the tilt gear 13 is rotated in a clockwise direction, the first connecting gears 131, 132, 133, and 134 are rotated in a counter-clockwise direction. As the first connecting gears 131, 132, 133, and 134 are rotated in a counter-clockwise direction, the second connecting gears 135, 136, 137, and 138 are rotated in a clockwise direction. As the second connecting gears 135, 136, 137, and 138 are rotated in a clockwise direction, the first gears 28, 38, 48, and 58 may be rotated in a counter-clockwise direction.

The tilt spacer mounted at each of the pad assemblies 2 may be rotated in a clockwise direction together with each of the first gears 28, 38, 48, and 58 mounted at each of the pad assemblies 2. As for the diagonal driving of the robot cleaner 1, the tilt spacer may be rotated in a clockwise direction within a range of greater than about 0° and less than about 90°. As one example, the tilt spacer may be rotated in a counter-clockwise direction at about 45°. According to the rotational angle and the rotational direction of the tilt spacer, the travelling direction of the robot cleaner 1 may be varied. Hereinafter, an embodiment in which the tilt spacer is rotated in a clockwise direction within the range of greater than about 0° and less than about 90° will be described.

As illustrated on FIG. 8B, as the tilt spacer is rotated in a counter-clockwise direction, the portion having greater frictional force in between the bottom surface of the pad assembly 2 and the floor surface may be changed in a counter-clockwise direction. The 'P1' of the first pad assembly 2*a* is moved to a position Q1, the 'P2' of the second pad assembly 2*b* is moved to a position Q2, the 'P3' of the third pad assembly 2*c* is moved to a position Q3, and the 'P4' of the fourth pad assembly 2*d* is moved to a position Q4.

The first pad assembly 2*a* is rotated in a counter-clockwise direction, and a frictional force in between the position Q1 and a floor surface may be generated in direction G2. The second pad assembly 2*b* is rotated in a clockwise direction, and a frictional force in between the position Q2 and the floor surface may be generated in the direction G2. The third pad assembly 2*c* is rotated in a counter-clockwise direction, and a frictional force in between the position Q3 and the floor surface may be generated in the direction G2. The fourth pad assembly 2*d* is rotated in a clockwise direction, and a frictional force in between the position Q4 and the floor surface may be generated toward the direction G2. Due to the frictional forces in the direction G2 generated in between the bottom surfaces of the first to fourth pad assemblies 2*a*, 2*b*, 2*c* and 2*d* and the floor surface, the robot cleaner 1 may travel in direction G1 that is a diagonal direction.

As described above, as the position of the portion having greater frictional force in between the bottom surface of the pad assembly 2 and the floor surface is moved while the tile spacer is rotated in a clockwise direction, the travelling direction of the robot cleaner 1 may be changed from a linear driving to a diagonal driving in direction G1.

Figure 9:
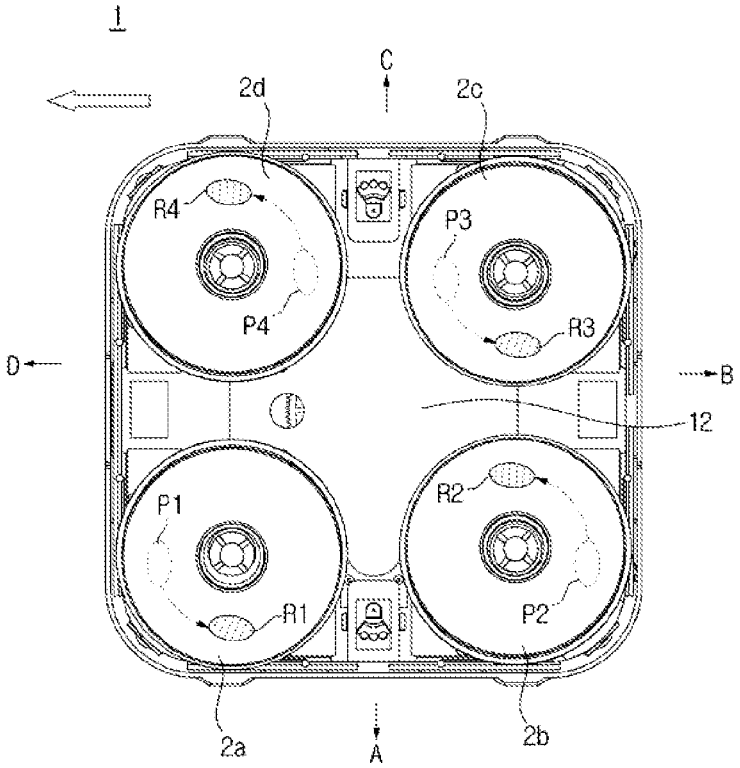
FIG. 9 is a drawing illustrating the robot cleaner driving in a sideway direction in accordance with one embodiment of the present disclosure.

FIG. 9 is a drawing illustrating the robot cleaner driving in a sideway direction in accordance with one embodiment of the present disclosure.

Referring to FIG. 8A and FIG. 9, the travelling direction of the robot cleaner 1 in accordance with one embodiment of the present disclosure may be changed to a sideway driving from a linear driving during the course of a linear driving. As the tilt spacer is rotated by the first motor 120, the position of the portion having greater frictional force in between the bottom surface of the pad assembly 2 and the floor surface is varied, and thus the travelling direction of the robot cleaner 1 may be changed.

During the course of a linear driving, the first pad assembly 2*a* may be rotated in a counter-clockwise direction by the second motor 121. At the first pad assembly 2*a*, the portion having greater frictional force in between the bottom surface of the first pad assembly 2*a* and the floor surface may be the position 'P1'. The second pad assembly 2*b* may be rotated by the second motor 122 in a clockwise direction. At the second pad assembly 2*b*, the portion having greater frictional force in between the bottom surface of the second pad assembly 2*b* and the floor surface may be the position 'P2'. The third pad assembly 2*c* may be rotated by the second motor 123 in a counter-clockwise direction. At the third pad assembly 2*c*, the portion having greater frictional force in between the bottom surface of the third pad assembly 2*c* and the floor surface may be the position 'P3'. The fourth pad assembly 2*d* may be rotated by the second motor 124 in a clockwise direction. At the fourth pad assembly 2*d*, the portion having greater frictional force in between the bottom surface of the fourth pad assembly 2*d* and the floor surface may be the position 'P4'.

As the driving gear 130 is rotated in a counter-clockwise direction by the first motor 120, the tilt gear 13 may be rotated in a clockwise direction. As the tilt gear 13 is rotated in a clockwise direction, the first connecting gears 131, 132, 133, and 134 are rotated in a counter-clockwise direction. As the first connecting gears 131, 132, 133, and 134 are rotated in a counter-clockwise direction, the second connecting gears 135, 136, 137, and 138 are rotated in a clockwise direction. As the second connecting gears 135, 136, 137, and 138 are rotated in a clockwise direction, the first gears 28, 38, 48, and 58 may be rotated in a counter-clockwise direction.

The tilt spacer mounted at each of the pad assemblies 2 may be rotated in a counter-clockwise direction together with each of the first gears 28, 38, 48, and 58 mounted at each of the pad assemblies 2. As for the sideway driving of the robot cleaner 1, the tilt spacer may be rotated by about 90° in the counter-clockwise direction. In a case when the tilt spacer is rotated by about 90° in a counter-clockwise direction, the robot cleaner 1 may drive toward a left side direction, that is, a direction 'D', so that the first pad assembly 2*a* and the fourth pad assembly 2*d* may be positioned at a front. On the contrary, in a case when the tilt spacer is rotated by about 90° in a clockwise direction, the robot cleaner 1 may drive toward a right side direction, that is, a direction 'B', so that the second pad assembly 2*b* and the third pad assembly 2*c* may be positioned at a front.

The first pad assembly 2*a* is rotated in a counter-clockwise direction, and a frictional force may be generated toward the direction 'B' in between a position 'R1' and the floor surface. The second pad assembly 2*b* is rotated in a clockwise direction, and a frictional force may be generated toward the direction 'B' in between a position 'R2' and the floor surface. The third pad assembly 2*c* is rotated in a counter-clockwise direction, and a frictional force may be generated toward the direction 'B' in between a position 'R3' and the floor surface. The fourth pad assembly 2*d* is rotated in a clockwise direction, and a frictional force may be generated toward the direction 'B' in between a position 'R4' and the floor surface. As described above, by the frictional forces that are generated toward the direction 'B' in between the floor surface and the bottom surfaces of the first to fourth pad assemblies 2*a* to 2*d*, the robot cleaner 1 may drive toward the left side direction, that is, the direction 'D'.

As described above, as the position of the portion having greater frictional force in between the bottom surface of the pad assembly 2 and the floor surface is varied while the tilt spacer is rotated in a clockwise direction or a counter-clockwise direction, the travelling direction of the robot cleaner 1 may be varied. The travelling direction of the robot cleaner 1 may be variously varied according to the rotated angle of the tilt spacer by the first motor 120. The pad assembly 2, by the second motors 121, 122, 123, and 124, may be able to wipe the floor surface by rotating while having the z-axis as a center of rotation. The travelling direction of the robot cleaner 1 may be varied according to the rotational direction of the second motors 121, 122, 123, and 124. The driving velocity of the robot cleaner 1 may be varied according to the rotational velocity of the second motors 121, 122, 123, and 124.

The pad assembly 2 of the robot cleaner 1 in accordance with one embodiment of the present disclosure may be provided in a way that the position of the portion having greater frictional force in between the bottom surface of the first pad assembly 2*a* and the floor surface may be symmetrical with respect to the position of the portion having greater frictional force in between the bottom surface of the second pad assembly 2*b* and the floor surface. The first pad assembly 2*a* and the second pad assembly 2*b* may be rotated toward opposite directions with respect to each other by the second motors 121 and 122. In the case of the third pad assembly 2*c* and the fourth pad assembly 2*d*, the position of the portion having greater frictional force in between the bottom surface of the third pad assembly 2*c* and the floor surface may be symmetrical with respect to the position of the portion having greater frictional force in between the bottom surface of the fourth pad assembly 2*d* and the floor surface. The third pad assembly 2*c* and the fourth pad assembly 2*d* may be rotated toward opposite directions with respect to each other by the second motors 123 and 124. The position of the portion having greater frictional force in between the bottom surface of the pad assembly 2 and the floor may be varied, and as the rotational direction of the pad assembly 2 is varied by the second motors, the robot cleaner 1 may be able to drive in various directions. As the rotational velocity of the pad assembly is varied by the second motors while having the z-axis as a center of rotation, the driving velocity of the robot cleaner 1 may be varied.

As described above, with respect to the robot cleaner having the plurality of pad assemblies configured to clean a floor surface by wiping, by using less number of motors, a floor surface is cleaned, and the robot cleaner may be able to drive in various directions. As the plurality of pad assemblies is simultaneously manipulated by the tilt gear unit, the direction of tilting may be varied, and thereby the control needed to change the direction of the robot cleaner may be conveniently taken place.

In the present disclosure, the contact portions and the rotational directions of the each of the pad assemblies, which are capable of linear driving, the diagonal driving, the sideway driving, are described as embodiments, and are not limited hereto, and through the combination of the contact portions and the rotational directions of the each of the pad assemblies having various shapes, the linear driving, the diagonal driving, the sideway driving may be possible. In addition, in the embodiments of the present disclosure, while the case of the four pad assemblies is described as an example, the embodiments of the present disclosure may also be applied to an robot cleaner applied with the two pad assemblies, for example, a case in which only the first pad assembly 2*a* and the second pad assembly 2*b*.

Processes according to the above-described example embodiments may be recorded in non-transitory computer-readable media including program instructions to implement various operations embodied by a computer. The media may also include, alone or in combination with the program instructions, data files, data structures, and the like. The program instructions recorded on the media may be those specially designed and constructed for the purposes of the example embodiments, or they may be of the kind well-known and available to those having skill in the computer software arts. The media may also include, alone or in combination with the program instructions, data files, data structures, and the like. Examples of non-transitory computer-readable media include magnetic media such as hard disks, floppy disks, and magnetic tape; optical media such as CD ROM discs and DVDs; magneto-optical media such as optical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter.

The described processes may be executed on a computer or processor configured to operate as a controller to perform processes described herein. For example, a computer or processor in the robot cleaner can operate as a controller to cause the robot to travel as described herein. For example, a computer or processor in the robot cleaner can operate as a controller to cause the various mechanisms described herein (for example, motors, gears, etc) to perform specific operations described herein to cause the robot cleaner to travel in manners described herein.

Figure 10:
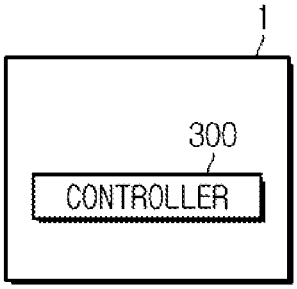
FIG. 10 is a drawing illustrating the robot cleaner in accordance with one embodiment of the present disclosure.

For example, FIG. 10 discloses a robot cleaner in accordance with an embodiment in which the robot cleaner 1 includes a controller 300 to cause the various mechanisms described herein to perform specific operations described herein to cause the robot cleaner to travel in manners described herein.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A robot cleaner, comprising:

a first motor;

a plurality of second motors;

four pad assemblies, each respective pad assembly of the four pad assemblies configured to rotate by receiving a driving force from one of the plurality of second motors, and provided in a tilted manner so that a bottom surface of the respective pad assembly has an uneven frictional force with respect to a surface to be cleaned; and a tilt gear configured to simultaneously vary tilting directions of the four pad assemblies, by receiving a driving force from the first motor.

2. The robot cleaner of claim 1, wherein:

the first motor is coupled to the tilt gear and the plurality of second motors are configured to rotate the bottom surfaces of the four pad assemblies clockwise or counter-clockwise.

3. The robot cleaner of claim 2, wherein each respective pad assembly of the four pad assemblies comprises:

a tilt spacer provided with a bottom surface thereof in an inclined manner;

a rotating panel configured to rotate by a respective second motor of the plurality of second motors; and a pad provided at a lower portion of the rotating panel.

4. The robot cleaner of claim 3, wherein each respective pad assembly of the four pad assemblies comprises:

an elastic unit provided in between the rotating panel of the respective pad assembly and the pad of the respective pad assembly such that the elastic unit allows a bottom surface of the pad to entirely make contact with the surface to be cleaned.

5. The robot cleaner of claim 3, wherein each respective pad assembly of the four pad assemblies further comprises:

a mounting unit, and the tilt spacer of the respective pad assembly is coupled to the mounting unit.

6. The robot cleaner of claim 5, wherein each respective pad assembly of the four pad assemblies comprises:

a first gear provided at the mounting unit of the respective pad assembly, and the first gear is coupled to the tilt gear via at least one other gear through tooth coupling.

7. The robot cleaner of claim 6, wherein, for each respective pad assembly of the four pad assemblies:

the driving force of the first motor is delivered to the first gear of the respective pad assembly through the tilt gear, thereby rotating the tilt spacer of the respective pad assembly to vary the direction of the inclination of the surface of the tilt spacer of the respective pad assembly.

8. The robot cleaner of claim 3, wherein each respective pad assembly of the four assemblies further comprises:

a joint shaft, and the rotating panel of the respective pad assembly is connected to the respective second motor of the plurality of second motors by the joint shaft.

9. The robot cleaner of claim 8, wherein, for each respective pad assembly of the four pad assemblies:

the joint shaft of the respective pad assembly is provided with a locking bar at one end portion thereof, and the rotating panel of the respective pad assembly is provided with an interference unit configured to be interfered by the locking bar.

10. The robot cleaner of claim 8, wherein, for each respective pad assembly of the four pad assemblies:

the tilt spacer of the respective pad assembly is provided with a hole formed therethrough, while the joint shaft of the respective pad assembly passes through the hole.

11. The robot cleaner of claim 8, wherein each respective pad assembly of the four pad assemblies comprises:

a second gear provided at an end portion of the joint shaft of the respective pad assembly, and the second gear is coupled to the respective second motor of the plurality of second motors, so that the joint shaft of the respective pad assembly and the rotating panel of the respective pad assembly are simultaneously rotated by a driving force of the respective second motor of the plurality of second motors.

12. The robot cleaner of claim 3, further comprising:

a controller configured to control a travelling direction of the robot cleaner by controlling the tilt gear to simultaneously vary the direction of the inclination of the bottom surface of the tilt spacer of each pad assembly of the four pad assemblies.

13. The robot cleaner of claim 12, wherein:

the controller is configured to cause the robot cleaner to travel in a linear manner by controlling the robot cleaner so that the directions of the inclinations of the bottom surfaces of the tilt spacers of a first pad assembly and a second pad assembly of the four pad assemblies are bilaterally symmetrical to each other, and so that rotational directions of the bottom surfaces of the first pad assembly and the second pad assembly are opposite to each other.

14. The robot cleaner of claim 12, wherein:

the controller is configured to cause the robot cleaner to travel in a diagonal manner by controlling the robot cleaner so that directions of the inclinations of the bottom surfaces of the tilt spacers of a first pad assembly and a second assembly of the four pad assemblies simultaneously rotate clockwise or counter-clockwise within a range of about 90 degrees from a state of being bilaterally symmetrical through operation of the tilt gear, and so that the rotational directions of the bottom surfaces of the first pad assembly and the second pad assembly are opposite to each other.

15. The robot cleaner of claim 12, wherein:

the controller is configured to cause the robot cleaner to travel in a sideway direction by controlling the robot cleaner so that the directions of the inclinations of the bottom surfaces of the tilt spacers of a first pad assembly and a second assembly of the four pad assemblies simultaneously rotate clockwise or counter-clockwise by an angle of 90 degrees from a state of being bilaterally symmetrical through operation of the tilt gear, and so that the rotational directions of the bottom surfaces of the first pad assembly and the second pad assembly are opposite to each other.

16. A robot cleaner, comprising:

a first motor provided at a base;

four pad assemblies each having a mounting unit mounted at the base, a tilt spacer provided at a lower portion of the mounting unit, a rotating panel rotatably provided at a bottom surface of the tilt spacer, and a pad configured to clean a surface;

a tilt gear configured to simultaneously deliver a rotating force of the first motor to the tilt spacer of each pad assembly of the four pad assemblies; and a plurality of second motors to respectively rotate the pads of the four pad assemblies clockwise or counter-clockwise, wherein a traveling direction of the robot cleaner is varied by uneven frictional forces produced between bottom surfaces of the pads and the surface to be cleaned.

17. The robot cleaner of claim 16, wherein:

as the rotating force of the first motor is delivered to the tilt spacer of each pad assembly of the four pad assemblies through the tilt gear, the tilt spacer of each pad assembly of the four pad assemblies is rotated clockwise or counter-clockwise, so that the direction of the inclination of the bottom surface of the tilt spacer of each pad assembly of the four pad assemblies is varied.

18. The robot cleaner of claim 16, wherein:

the tilt spacers are simultaneously rotated in the same direction by the tilt gear.

19. The robot cleaner of claim 16, wherein each pad assembly of the four pad assemblies further comprises a joint shaft provided with a hooking unit configured to interfere with the rotating panel of the respective pad assembly, and the joint shaft is rotatably connected to a second motor of the plurality of second motors.

20. The robot cleaner of claim 16, wherein each respective pad assembly of the four pad assemblies comprises:

an elastic unit in between the rotating panel of the respective pad assembly and the pad of the respective pad assembly such that the elastic unit allows the bottom surface of the pad to entirely make contact with the surface to be cleaned.

21. A robot cleaner comprising:

a first pad assembly configured to, when the robot cleaner is positioned on a surface to be cleaned with a pad at an end of the first pad assembly contacting the surface to be cleaned, rotate the pad about a rotation axis perpendicular to the surface to be cleaned, the first pad assembly including a tilt spacer having a surface that, when the robot cleaner is positioned on the surface to be cleaned with the pad at the end of the first pad assembly contacting the surface to be cleaned and being rotated, is inclined at an acute angle with respect to the surface to be cleaned so that a portion of a contact area between the pad at the end of the first pad assembly and the surface to be cleaned has a greater frictional force than a remaining portion of the contact area;

a second pad assembly configured to, when the robot cleaner is positioned on the surface to be cleaned with a pad at an end of the second pad assembly contacting the surface to be cleaned, rotate the pad at the end of the second pad assembly about a rotation axis perpendicular to the surface to be cleaned, the second pad assembly including a tilt spacer having a surface that, when the robot cleaner is positioned on the surface to be cleaned with the pad at the end of the second pad assembly contacting the surface to be cleaned and being rotated, is inclined at an acute angle with respect to the surface to be cleaned so that a portion of a contact area between the pad at the end of the second pad assembly and the surface to be cleaned has a greater frictional force than a remaining portion of the contact area; and a motor and at least one gear to control a traveling direction of the robot cleaner along the surface to be cleaned by varying at least one of:

a direction of the inclination of the surface of the tilt spacer of the first pad assembly while maintaining the inclination of the surface of the tilt spacer of the first pad assembly, to move a position of said portion of the contact area between the pad at the end of the first pad assembly and the surface to be cleaned, and a direction of the inclination of the surface of the tilt spacer of the second pad assembly while maintaining the inclination of the surface of the tilt spacer of the second pad assembly, to move a position of said portion of the contact area between the pad at the end of the second pad assembly and the surface to be cleaned.

22. The robot cleaner of claim 21, wherein the motor and the at least one gear are configured to simultaneously deliver a rotating force to each of the first pad assembly and the second pad assembly, to simultaneously rotate the tilt spacer of the first pad assembly and the tilt spacer of the second pad assembly to thereby simultaneously vary the direction of the inclination of the surface of the tilt spacer of the first pad assembly and the direction of the inclination of the surface of the tilt spacer of the second pad assembly, to thereby control the traveling direction of the robot cleaner along the surface to be cleaned.

23. A robot cleaner comprising:

a first pad assembly configured to, when the robot cleaner is positioned on a surface to be cleaned by the robot cleaner with a pad at an end of the first pad assembly contacting the surface to be cleaned, rotate the pad at the end of the first pad assembly about a rotation axis perpendicular to the surface to be cleaned, the first pad assembly including a tilt spacer having a surface that, when the robot cleaner is positioned on the surface to be cleaned with the pad at the end of the first pad assembly contacting the surface to be cleaned and being rotated, is inclined at an acute angle with respect to the surface to be cleaned so that a portion of a contact area between the pad at the end of the first pad assembly and the surface to be cleaned has a greater frictional force than a remaining portion of the contact area;

a second pad assembly configured to, when the robot cleaner positioned on the surface to be cleaned with a pad at an end of the second pad assembly contacting the surface to be cleaned, rotate the pad at the end of the second pad assembly about a rotation axis perpendicular to the surface to be cleaned, the second pad assembly including a tilt spacer having a surface that, when the robot cleaner is positioned on the surface to be cleaned with the pad at the end of the second pad assembly contacting the surface to be cleaned and being rotated, is inclined at an acute angle with respect to the surface to be cleaned so that a portion of a contact area between the pad at the end of the second pad assembly and the surface to be cleaned has a greater frictional force than a remaining portion of the contact area; and a controller to control a traveling direction of the robot cleaner along the surface to be cleaned by causing at least one of the following to be varied:

a direction of the inclination of the surface of the tilt spacer of the first pad assembly while maintaining the inclination of the surface of the tilt spacer of the first pad assembly, to move a position of said portion of the contact area between the pad at the end of the first pad assembly and the surface to be cleaned, and a direction of the inclination of the surface of the tilt spacer of the second pad assembly while maintaining the inclination of the surface of the tilt spacer of the second pad assembly, to move a position of said portion of the contact area between the pad at the end of the second pad assembly and the surface to be cleaned.

24. The robot cleaner of claim 23, wherein the controller causes a rotating force to be simultaneously delivered to each of the first pad assembly and the second pad assembly, to simultaneously rotate the tilt spacer of the first pad assembly and the tilt spacer of the second spacer to thereby simultaneously vary the direction of the inclination of the surface of the tilt spacer of the first pad assembly and the direction of the inclination of the surface of the tilt spacer of the second pad assembly, to thereby control the traveling direction of the robot cleaner along the surface to be cleaned.

25. A robot cleaner comprising:

a first motor;

a second motor; and a pad assembly configured to, when the robot cleaner is positioned on a surface to be cleaned by the robot cleaner with a pad at an end of the pad assembly contacting the surface to be cleaned, rotate the pad about a rotation axis perpendicular to the surface to be cleaned by receiving a driving force from the second motor, the pad assembly including a tilt spacer having a surface that, when the robot cleaner is positioned on the surface to be cleaned with the pad contacting the surface to be cleaned and being rotated, is inclined at an acute angle with respect to the surface to be cleaned so that a portion of a contact area between the pad and the surface to be cleaned has a greater frictional force than a remaining portion of the contact area, the pad assembly being further configured to vary a direction of the inclination of the surface of the tilt spacer while maintaining the inclination of the surface of the tilt spacer, by rotating the tilt spacer through a driving force from the first motor.

26. A robot cleaner comprising:

a pad assembly configured to, when the robot cleaner is positioned on a surface to be cleaned by the robot cleaner with a pad at an end of the pad assembly contacting the surface to be cleaned, rotate the pad about a rotation axis perpendicular to the surface to be cleaned, the pad assembly including a tilt spacer having a surface that, when the robot cleaner is positioned on the surface to be cleaned with the pad contacting the surface to be cleaned and being rotated, is inclined at an acute angle with respect to the surface to be cleaned so that a portion of a contact area between the pad and the surface to be cleaned has a greater frictional force than a remaining portion of the contact area, the pad assembly being further configured to vary a direction of the inclination of the surface of the tilt spacer while maintaining the inclination of the surface of the tilt spacer, to vary a location of the portion of the contact area and thereby control movement of the robot cleaner on the surface to be cleaned.

* * * * *